US012781299B2

(12) United States Patent
Park et al.

(10) Patent No.: US 12,781,299 B2
(45) Date of Patent: Nov. 3, 2026

(54) HIGH-STRENGTH HOT-ROLLED STEEL SHEET HAVING EXCELLENT YIELD RATIO, AND METHOD FOR MANUFACTURING SAME

(71) Applicant: POSCO, Pohang-si (KR)

(72) Inventors: Kyongsu Park, Gyeongsangbuk-do (KR); Deukjung Kim, Gyeongsangbuk-do (KR); Hak-jun Kim, Gyeongsangbuk-do (KR)

(73) Assignee: POSCO CO., LTD, Pohang-si (KR)

( * ) Notice: Subject to any disclaimer, the term of this patent is extended or adjusted under 35 U.S.C. 154(b) by 711 days.

(21) Appl. No.: 17/784,728

(22) PCT Filed: Nov. 11, 2020

(86) PCT No.: PCT/KR2020/015769
§ 371 (c)(1),
(2) Date: Jun. 13, 2022

(87) PCT Pub. No.: WO2021/125563
PCT Pub. Date: Jun. 24, 2021

(65) Prior Publication Data

US 2023/0012991 A1 Jan. 19, 2023

(30) Foreign Application Priority Data

Dec. 20, 2019 (KR) ..... 10-2019-0172004

(51) Int. Cl.

| | |
|---|---|
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |

(52) U.S. Cl.
CPC ..... *C21D 8/0226* (2013.01); *C21D 8/0263* (2013.01); *C21D 9/46* (2013.01); *C22C 38/002* (2013.01); *C22C 38/02* (2013.01); *C22C 38/04* (2013.01); *C21D 2211/008* (2013.01)

(58) Field of Classification Search
CPC ..... C21D 8/0226; C21D 9/46; C21D 8/0263; C21D 2211/008; C21D 8/02; C21D 8/025
See application file for complete search history.

(56) References Cited

U.S. PATENT DOCUMENTS

| | | | | |
|---|---|---|---|---|
| 6,284,063 | B1 | 9/2001 | Espenhahn et al. | |
| 11,846,003 | B2 * | 12/2023 | Hirashima | C21D 9/46 |
| 2005/0155673 | A1 | 7/2005 | Soshiroda et al. | |
| 2014/0251513 | A1 | 9/2014 | Kami et al. | |
| 2018/0112286 | A1 * | 4/2018 | Kim | C22C 38/28 |
| 2022/0074007 | A1 | 3/2022 | Park | |
| 2025/0019812 | A1 * | 1/2025 | Yi | C22C 38/54 |

FOREIGN PATENT DOCUMENTS

| | | | | | |
|---|---|---|---|---|---|
| CN | 103589954 | A | | 2/2014 | |
| CN | 105734412 | A | * | 7/2016 | C22C 38/32 |
| CN | 107532262 | A | | 1/2018 | |
| CN | 107779766 | A | | 3/2018 | |
| EP | 1396549 | A1 | | 3/2004 | |
| JP | 2005-298967 | A | | 10/2005 | |
| JP | 2010-121191 | A | | 6/2010 | |
| JP | 2014201781 | A | | 10/2014 | |
| JP | 2014-227583 | A | | 12/2014 | |
| JP | 2017-057472 | A | | 3/2017 | |
| JP | 2018-031077 | A | | 3/2018 | |
| JP | 2018-518596 | A | | 7/2018 | |
| JP | 2018-188675 | A | | 11/2018 | |
| JP | 2019173156 | | * | 10/2019 | B32B 15/013 |
| JP | 2022-513993 | A | | 2/2022 | |
| KR | 10-2005-0113247 | A | | 12/2005 | |
| KR | 10-2011-0076431 | A | | 7/2011 | |
| KR | 10-2012-0001018 | A | | 1/2012 | |
| KR | 10-2015-0014736 | A | | 2/2015 | |
| KR | 10-2015-0046927 | A | | 5/2015 | |
| KR | 10-2015-0075307 | A | | 7/2015 | |

OTHER PUBLICATIONS

JP 2019173156 machine translation of bibliography, claims, and description (Year: 2019).*
KR 101546134 B1 original document and machine translation (Year: 2015).*
CN 107779766 A machine translation and original document (Year: 2018).*
CN-105734412-A machine translation (Year: 2016).*
Office Action issued Jan. 18, 2024 for Chinese Patent Application No. 202080092129.3 (See English Translation).
Office Action issued Jan. 30, 2024 for Japanese Patent Application No. 2022-538353 (See English Translation).
Extended European Search Report issued Feb. 15, 2024 for European Patent Application No. 20901952.0.
Supplementary European Search Report issued Mar. 5, 2024 for European Patent Application No. 20901952.0.
Chinese Office Action dated Jul. 12, 2023 issued in Chinese Patent Application No. 202080092129.3 (with English translation).
Japanese Office Action dated Aug. 8, 2023 issued in Japanese Patent Application No. 2022-538353 (with English translation).
(Continued)

*Primary Examiner* — Tima M. McGuthry-Banks
(74) *Attorney, Agent, or Firm* — Morgan Lewis & Bockius LLP

(57) ABSTRACT

Disclosed is a follow-up process-omitting type high-strength hot-rolled steel sheet having an excellent yield ratio and a method for manufacturing the same. The hot-rolled steel sheet includes, in percent by weight (wt %), 0.12% or more and less than 0.3% of C, 0.5% or less of Si (excluding 0), 0.1 to 2.5% of Mn, 0.0005 to 0.005% of B, 0.02% or less of P, 0.01% or less of S, and the balance of Fe and inevitable impurities, has a microstructure including at least 95 vol % of martensite, has a yield ratio (yield strength/tensile strength) of 0.75 or more, is manufactured by continuous hot rolling, and is manufactured without performing a follow-up process such as cold rolling and heat treatment.

4 Claims, No Drawings

(56) References Cited

OTHER PUBLICATIONS

Chinese Office Action dated Jun. 25, 2024 issued in Chinese Patent Application No. 202080092129.3 (with English translation).
International Search Report (with partial English translation) dated Feb. 24, 2021 issued in International Patent Application No. PCT/KR2020/015769.

* cited by examiner

HIGH-STRENGTH HOT-ROLLED STEEL SHEET HAVING EXCELLENT YIELD RATIO, AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/0015769, filed on Nov. 11, 2020, which in turn claims the benefit of Korean Application No. 10-2019-0172004, filed on Dec. 20, 2019, the entire disclosures of which applications are incorporated by reference herein.

TECHNICAL FIELD

The present disclosure relates to a hot-rolled steel sheet used as a material for automotive collision parts and structural supports, and more particularly, to a follow-up process-omitting type high-strength hot-rolled steel sheet having an excellent yield ratio and manufactured without performing a follow-up process such as heat treatment and cold rolling and a method for manufacturing the same.

BACKGROUND ART

Steel materials used as materials for automotive collision parts and structural supports need to have high strength for safety. In addition, not only high tensile strength but also high yield strength are required therefor. A variety of studies related to precipitation hardening or transformation hardening to obtain high strength of steel materials have been conducted.

As methods for obtaining strength of hot-rolled steel sheets, patent documents listed below have been published.

Patent Document 1 discloses a technique for obtaining strength by precipitation hardening in accordance with addition of alloying elements. Attempts have been made to obtain high strength by adding alloying elements such as Ti, Nb, V, and Mo in Patent Document 1. However, this method is not advantageous in terms of economic feasibility due to an increase in manufacturing costs since these alloying elements are expensive.

Patent Documents 2 to 4 disclose techniques for obtaining strength and ductility by using a dual-phase structure of ferrite and martensite or a complex structure of ferrite, bainite, and martensite with retained austenite. However, ferrite or retained austenite has low strength despite high ductility, and thus there is a technical difficulty in sufficiently obtaining high strength.

(Patent Document 1) Korean Patent Laid-open Publication No. 10-2005-0113247 (Dec. 1, 2005)

(Patent Document 2) Japanese Patent Application Laid-Open No. 2005-298967 (Oct. 27, 2005)

(Patent Document 3) US Patent Application Publication No. 2005-0155673 (Jul. 21, 2005)

(Patent Document 4) European Patent Application Publication No. 1396549 (Mar. 10, 2004)

DISCLOSURE

Technical Problem

Provided is a high-strength hot-rolled steel sheet having an excellent yield ratio and manufactured without performing a follow-process and a method for manufacturing the same.

Technical Solution

In accordance with an aspect of the present disclosure, a high-strength hot-rolled steel sheet having an excellent yield ratio includes, in percent by weight (wt %), 0.12% or more and less than 0.3% of C, 0.5% or less of Si (excluding 0), 0.1 to 2.5% of Mn, 0.0005 to 0.005% of B, 0.02% or less of P, 0.01% or less of S, and the balance of Fe and inevitable impurities, has a microstructure including at least 95 vol % of martensite, and has a yield ratio (yield strength/tensile strength) of 0.75 or more.

In addition, according to an embodiment of the present disclosure, the high-strength hot-rolled steel sheet may further include at least one selected from 0.5% or less of Cr and 0.005 to 0.2% of Ti.

In addition, according to an embodiment of the present disclosure, the microstructure may include at least one of ferrite, bainite, retained austenite, and a carbide, and a sum thereof may be 5 vol % or less.

In addition, according to an embodiment of the present disclosure, a tensile strength may be 1,250 MPa or more.

In addition, according to an embodiment of the present disclosure, a yield strength may be 1,000 MPa or more.

In addition, according to an embodiment of the present disclosure, a thickness of the hot-rolled steel sheet may be 1.5 mm or less.

In accordance with another aspect of the present disclosure, a method for manufacturing a high-strength hot-rolled steel sheet having an excellent yield ratio includes: reheating a slab including, in percent by weight (wt %), 0.12% or more and less than 0.3% of C, 0.5% or less of Si (excluding 0), 0.1 to 2.5% of Mn, 0.0005 to 0.005% of B, 0.02% or less of P, 0.01% or less of S, and the balance of Fe and inevitable impurities; continuous hot rolling the reheated slab to a thickness of 1.5 mm or less; initiating cooling within 5 seconds after termination of the hot rolling and cooling a hot-rolled steel sheet at a cooling rate of 50 to 1,000° C./s; and coiling the cooled hot-rolled steel sheet.

In addition, according to an embodiment of the present disclosure, a cooling termination temperature may be from 150 to 350° C. in the cooling process.

In addition, according to an embodiment of the present disclosure, the slab may further include at least one selected from 0.5% or less of Cr and 0.005 to 0.2% of Ti.

Advantageous Effects

According to embodiments of the present disclosure, a hot-rolled steel sheet having high strength and an excellent yield ratio and a method for manufacturing the same may be provided.

Also, provided are a follow-up process-omitting type hot-rolled steel sheet having high strength properties and an excellent yield ratio manufactured without performing a follow-up process such as heat treatment and cold rolling and a method of manufacturing the same.

BEST MODE

A high-strength hot-rolled steel sheet having an excellent yield ratio according to an embodiment of the present disclosure includes, in percent by weight (wt %), 0.12% or more and less than 0.3% of C, 0.5% or less of Si (excluding 0), 0.1 to 2.5% of Mn, 0.0005 to 0.005% of B, 0.02% or less of P, 0.01% or less of S, and the balance of Fe and inevitable impurities, has a microstructure including at least 95 vol % of martensite, and has a yield ratio (yield strength/tensile strength) of 0.75 or more.

Modes of the Invention

Hereinafter, embodiments of the present disclosure will be described in detail with reference to the accompanying drawings. The following embodiments are provided to fully convey the spirit of the present disclosure to a person having ordinary skill in the art to which the present disclosure belongs. The present disclosure is not limited to the embodiments shown herein but may be embodied in other forms. In the drawings, parts unrelated to the descriptions are omitted for clear description of the disclosure and sizes of elements may be exaggerated for clarity.

Throughout the specification, the term "include" an element does not preclude other elements but may further include another element, unless otherwise stated.

The present disclosure relates to a high-strength hot-rolled steel sheet having an excellent yield ratio and a method for manufacturing the same. Hereinafter, embodiments of the present disclosure will be described. The invention may, however, be embodied in many different forms and should not be construed as being limited to the embodiments set forth herein. Rather, these embodiments are provided so that this disclosure will be thorough and complete, and will fully convey the concept of the invention to those skilled in the art.

A high-strength hot-rolled steel sheet having an excellent yield ratio according to an embodiment of the present disclosure includes, in percent by weight (wt %), 0.12% or more and less than 0.3% of C, 0.5% or less of Si (excluding 0), 0.1 to 2.5% of Mn, 0.0005 to 0.005% of B, 0.02% or less of P, 0.01% or less of S, and the balance of Fe and inevitable impurities.

Hereinafter, reasons for numerical limitations on the contents of alloying elements in the embodiment of the present disclosure will be described. Hereinafter, the unit is wt % unless otherwise stated.

The content of C is 0.12% or more and less than 0.3%.

C is an element effectively contributing to an increase in strength, and thus the hot-rolled steel sheet of the present disclosure may include C in a certain level or higher to obtain strength. In addition, when the C content is below the certain level, a low-temperature structure is formed in a large quantity during cooling after hot rolling, and thus the microstructure desired by the present disclosure may not be obtained. Therefore, a lower limit of the C content is controlled to 0.12%. On the contrary, when the C content is excessive, strength may be increased but weldability may deteriorate. Thus, the C content is controlled to be less than 0.30% in the present disclosure. Therefore, the C content may be 0.12% or more and less than 0.3%.

The content of Si is greater than 0 and 0.5% or less.

As an element with high affinity with oxygen, Si may cause deterioration of surface quality due to surface scale when added in a large amount and may deteriorate weldability. Therefore, an upper limit of the Si content is controlled to 0.5% in the present disclosure. However, because Si not only serves as a deoxidizer but also contributes to enhancement of strength of steel, a lower limit of the Si content may exclude 0% in the present disclosure.

The content of Mn is from 0.1 to 2.5%.

Mn is an element effectively contributing to enhancement of strength and hardenability of a steel. In addition, Mn binds to S, which is unavoidably introduced during a steel making process, to form MnS, and thus Mn may be used as an element effectively preventing cracks caused by S. Therefore, a lower limit of the Mn content is controlled to 0.1% to obtain these effects. However, an excess of Mn may cause a decrease in the tensile strength due to retained austenite and may deteriorate weldability and economic feasibility, and thus an upper limit of the Mn content is controlled to 2.5% in the present disclosure. Therefore, the Mn content may be controlled in the range of 0.1 to 2.5% in the present disclosure.

The content of B is from 0.0005 to 0.005%.

B, as an element effectively contributing to enhancement of hardenability of a steel, may effectively inhibit transformation into a low-temperature structure such as ferrite and pearlite during cooling after hot rolling even by adding a small amount. Therefore, in the present disclosure, a lower limit of the B content is controlled to 0.0005% to obtain such effects. On the contrary, an excess of B may react with Fe causing embrittlement of grain boundaries. Therefore, an upper limit of the B content is controlled to 0.005%. Therefore, the B content may be in the range of 0.0005 to 0.005% in the present disclosure.

The content of P is 0.02% or less.

P is a major element segregated in grain boundaries to cause deterioration of toughness of a steel. Therefore, it is desirable to control the P content as low as possible. Therefore, it is theoretically most preferable to control the P content to 0%. However, P is an element unavoidably introduced into a steel during a steel making process, and an excessive processing load may be caused to control the P content to 0%. Therefore, an upper limit of the P content may be controlled to 0.02% in the present disclosure in consideration thereof.

The content of S is 0.01% or less.

S is a major element forming MnS to increase the amount of precipitates and cause embrittlement of a steel. Thus, it is desirable to control the S content as low as possible. Therefore, it is theoretically most preferable to control the S content to 0%. However, S is also an element unavoidably introduced into a steel during a steel making process, and an excessive processing load may be caused to control the S content to 0%. Therefore, an upper limit of the S content may be controlled to 0.01% in the present disclosure in consideration thereof.

Also, according to an embodiment of the present disclosure, the high-strength hot-rolled steel sheet may further include at least one of 0.5% or less of Cr and 0.005 to 0.2% of Ti.

The content of Cr is 0.5% or less.

As an element contributing to enhancement of hardenability of a steel, Cr may further be added according to the present disclosure to obtain this effect. However, addition of a large amount of Cr, which is an expensive element, is undesirable in terms of economic feasibility. When Cr is added excessively, weldability may deteriorate, and thus an upper limit of Cr may be controlled to 0.5%.

The content of Ti is from 0.005 to 0.2%.

In general, Ti is an element known to bind C and N to form a carbide and a nitride. In the present disclosure, B is essentially added to the steel to obtain hardenability. However, in the case where N contained in a steel binds to B, the effect of adding B cannot be obtained. On the contrary, in the case of adding Ti, N binds to Ti to form a nitride before binding to B, and therefore the effect of adding B may be enhanced. Therefore, in order to obtain this effect, Ti may be added in an amount of 0.005% or more in the present disclosure. However, an excess of Ti may deteriorate castability in the step of preparing the slab, and thus an upper limit of the Ti content may be controlled to 0.2% in the present disclosure. Therefore, the Ti content may be controlled in the range of 0.005 to 0.2% in the present disclosure.

The remaining components of the steel sheet except for the above-described alloying elements are Fe and other inevitable impurities. Addition of any other element in addition to the above-described elements is not excluded.

The present inventors carried out research on conditions enabling to obtain high strength and yield ratio even when a follow-up process is omitted. In the past, it was recognized that the follow-up process such as heat treatment and cold rolling should be conducted in order to obtain high strength and yield ratio. However, as a result of extensive studies, it has been found that both high strength and yield ratio may be obtained by controlling not only the type of the microstructure of steels but also a fraction of a particular microstructure.

According to an embodiment of the present disclosure, the high-strength hot-rolled steel sheet may have a microstructure including at least 95 vol % of martensite, and may include at least one of ferrite, bainite, retained austenite, and a carbide such that a sum thereof is 5 vol % or less.

The high-strength hot-rolled steel sheet may include martensite as a matrix structure, and a fraction of martensite may be 95 vol % or more based on a total volume of the hot-rolled steel sheet. Because martensite that is a hard structure is contained in an amount of 95% or more according to the present disclosure, both high strength and an excellent yield ratio may be obtained. Addition of any structures other than martensite is not excluded. However, the ferrite, bainite, carbide, and retained austenite are not preferable to obtain strength, and thus a total fraction thereof may be limited to be 5 vol % or less, more preferably, the total fraction thereof may be strictly limited to be 3 vol % or less. In addition, the hot-rolled steel sheet may further include cementite and precipitates in addition to the above-described structures as remaining structures.

According to an embodiment of the present disclosure, the hot-rolled steel sheet may have a yield ratio (yield strength/tensile strength) of 0.75 or more, a tensile strength (TS) of 1,250 MPa or more, and a yield strength (YS) of 1,000 MPa or more.

Also, although a thickness of the hot-rolled steel sheet according to the present disclosure is not particularly limited, economic feasibility and light weight of final products may be obtained by decreasing the thickness with excellent strength and workability. Therefore, the thickness of the hot-rolled steel sheet according to an embodiment of the present disclosure may be 1.5 mm or less, and more preferably 1.4 mm or less.

Then, a method for manufacturing a high-strength hot-rolled steel sheet having an excellent yield ratio according to an embodiment of the present disclosure will be described.

A method for manufacturing a high-strength hot-rolled steel sheet having an excellent yield ratio according to an embodiment of the present disclosure includes: reheating a slab including, in percent by weight (wt %), 0.12% or more and less than 0.3% of C, 0.5% or less of Si (excluding 0), 0.1 to 2.5% of Mn, 0.0005 to 0.005% of B, 0.02% or less of P, 0.01% or less of S, and the balance of Fe and inevitable impurities; hot rolling the reheated slab; initiating cooling within 5 seconds after termination of the hot rolling and cooling a hot-rolled steel sheet at a cooling rate of 50 to 1,000° C./s; and coiling the cooled hot-rolled steel sheet.

The slab having the above-described composition is reheated and hot-rolled. Slabs manufactured according to a common slab-manufacturing process may be reheated in a predetermined temperature range. For sufficient homogenization treatment, a lower limit of the reheating temperature may be controlled to 1,050° C., and an upper limit of the reheating temperature may be controlled to 1,350° C. in consideration of economic feasibility and surface quality.

The reheated slab may be finish-rolled to a thickness of 1.5 mm or less by continuous hot rolling. A thin hot-rolled steel sheet is desired to be prepared according to the present disclosure, and thus continuous rolling in which a preceding steel and a following steel are continuously rolled without separation is performed. The continuous hot rolling in which rolling is continuously performed is more preferable in terms of obtaining a thickness of the hot-rolled steel sheet. A finish rolling temperature may be in a range of 800 to 950° C. to control a rolling load and reduce surface scale.

Immediately after the hot rolling, the hot-rolled steel sheet is quenched. Within 5 seconds after the continuous hot rolling is terminated, the cooling may be initiated. In the present disclosure, the microstructure of the hot-rolled steel sheet is desired to be strictly controlled, and thus the cooling may be initiated within 5 seconds immediately after the hot rolling is terminated. When the time from termination of the hot rolling to initiation of the cooling exceeds 5 seconds, ferrite, pearlite, and bainite, which are not intended to obtain in the present disclosure, may be formed by air cooling in the atmosphere. The time from termination of the hot rolling to initiation of the cooling may preferably be within 3 seconds.

The cooling of the hot-rolled steel sheet may be performed to a cooling termination temperature of 150 to 350° C. at a cooling rate of 50 to 1,000° C./s. When the cooling rate is less than 50° C./s, transformation into ferrite, pearlite, or bainite occurs during the cooling, and thus the microstructure desired by the present disclosure cannot be obtained. Although an upper limit of the cooling rate to obtain the microstructure desired by the present disclosure is not particularly limited, the upper limit of the cooling rate may be controlled to 1,000° C./s in consideration of facility limitations and economic feasibility. In addition, when the cooling termination temperature is below 150° C., a sufficient yield strength cannot be obtained, thereby decreasing the yield ratio. When the cooling termination temperature exceeds 350° C., transformation into ferrite, pearlite, or bainite is unavoidable, failing to obtain the microstructure desired by the present disclosure.

Subsequently, the cooled hot-rolled steel sheet may be coiled.

The hot-rolled steel sheet prepared according to the manufacturing method described above may have a tensile strength (TS) of 1,250 MPa or more, a yield strength (YS) of 1,000 MPa or more, and may also have a yield ratio (yield strength/tensile strength) of 0.75 or more although a follow-up process such as heat treatment and cold rolling is not performed. Therefore, the follow-up process may be omitted.

Hereinafter, the present disclosure will be described in more detail with reference to the following examples.

EXAMPLES

Slabs having the compositions of alloying elements shown in Table 1 below were prepared and hot-rolled steel sheet samples were obtained under the conditions shown in Table 2 below. Each of the slabs was manufactured according to a common manufacturing method and homogenized by reheating in a temperature range of 1,050 to 1,350° C. Continuous hot rolling was used as hot rolling.

TABLE 1

| Steel type | C | Si | Mn | P | S | B | Cr | Ti |
|---|---|---|---|---|---|---|---|---|
| A | 0.216 | 0.04 | 1.01 | 0.007 | 0.003 | 0.0020 | 0.02 | 0.0180 |
| B | 0.135 | 0.06 | 1.22 | 0.012 | 0.003 | 0.0022 | 0.04 | 0.0200 |
| C | 0.151 | 0.03 | 0.99 | 0.016 | 0.001 | 0.0021 | 0.05 | 0.0180 |
| D | 0.244 | 0.07 | 1.06 | 0.013 | 0.002 | 0.0020 | 0.04 | 0.0190 |
| E | 0.221 | 0.03 | 2.01 | 0.015 | 0.001 | 0.0019 | 0.03 | 0.0200 |
| F | 0.211 | 0.05 | 1.09 | 0.007 | 0.010 | 0.0021 | 0.05 | 0.1100 |
| G | 0.218 | 0.04 | 0.96 | 0.006 | 0.009 | 0.0020 | 0.02 | 0.0200 |
| H | 0.090 | 0.04 | 0.98 | 0.007 | 0.007 | 0.0018 | 0.02 | 0.0210 |
| I | 0.221 | 0.07 | 1.01 | 0.012 | 0.001 | 0.0003 | 0.03 | 0.0200 |
| J | 0.164 | 0.08 | 3.14 | 0.011 | 0.004 | 0.0019 | 0.04 | 0.0210 |
| K | 0.214 | 0.06 | 1.12 | 0.009 | 0.006 | 0.0180 | 0.03 | 0.0010 |

TABLE 2

| Example | Steel type | Hot rolling termination temperature (° C.) | Thickness (mm) | Time from termination of rolling to initiation of cooling (sec) | Cooling rate (° C./sec) | Cooling termination temperature (° C.) |
|---|---|---|---|---|---|---|
| Example 1 | A | 860 | 1.4 | 1.2 | 100 | 236 |
| Example 2 | A | 874 | 1.4 | 1.5 | 200 | 208 |
| Example 3 | A | 893 | 1.4 | 0.9 | 300 | 204 |
| Example 4 | A | 919 | 1.4 | 0.8 | 100 | 289 |
| Example 5 | A | 885 | 1.2 | 2.8 | 100 | 180 |
| Example 6 | B | 916 | 1.4 | 1.2 | 100 | 246 |
| Example 7 | C | 860 | 1.4 | 1.1 | 100 | 181 |
| Example 8 | D | 861 | 1.4 | 0.5 | 100 | 227 |
| Example 9 | E | 880 | 1.4 | 0.8 | 100 | 155 |
| Example 10 | F | 897 | 1.4 | 1.1 | 100 | 245 |
| Example 11 | G | 897 | 1.4 | 1.7 | 100 | 233 |
| Comparative Example 1 | A | 885 | 1.2 | 2.6 | 100 | 140 |
| Comparative Example 2 | A | 884 | 1.4 | 6.1 | 100 | 194 |
| Comparative Example 3 | A | 884 | 1.4 | 5.7 | 100 | 129 |
| Comparative Example 4 | A | 873 | 1.4 | 1.0 | 30 | 202 |
| Comparative Example 5 | C | 860 | 1.4 | 1.1 | 100 | 451 |
| Comparative Example 6 | G | 897 | 1.4 | 1.7 | 100 | 118 |
| Comparative Example 7 | H | 903 | 1.4 | 0.5 | 100 | 220 |
| Comparative Example 8 | I | 908 | 1.4 | 1.6 | 100 | 284 |
| Comparative Example 9 | J | 899 | 1.4 | 1.6 | 100 | 211 |
| Comparative Example 10 | K | 886 | 1.4 | 1.1 | 100 | 198 |

Microstructures and mechanical properties of the respective samples prepared under the conditions shown in Table 2 were measured and shown in Table 3 below. The microstructures were evaluated by image analysis after obtaining images thereof using an optical microscope and a scanning electron microscope. Among mechanical properties, tensile strength was evaluated by performing a tensile test in a C direction according to the DIN standard.

TABLE 3

| Example | Steel type | Fraction of martensite (vol %) | Tensile strength (MPa) | Yield strength (MPa) | Yield ratio |
|---|---|---|---|---|---|
| Example 1 | A | 98 | 1,610 | 1,338 | 0.831 |
| Example 2 | A | 97 | 1,619 | 1,261 | 0.779 |
| Example 3 | A | 98 | 1,520 | 1,248 | 0.821 |
| Example 4 | A | 96 | 1,621 | 1,325 | 0.817 |
| Example 5 | A | 97 | 1,612 | 1,241 | 0.770 |
| Example 6 | B | 96 | 1,287 | 1,086 | 0.844 |
| Example 7 | C | 96 | 1,383 | 1,055 | 0.763 |
| Example 8 | D | 96 | 1,674 | 1,351 | 0.807 |
| Example 9 | E | 97 | 1,622 | 1,227 | 0.756 |
| Example 10 | F | 98 | 1,648 | 1,365 | 0.828 |
| Example 11 | G | 96 | 1,545 | 1,249 | 0.808 |
| Comparative Example 1 | A | 97 | 1,624 | 1,187 | 0.731 |
| Comparative Example 2 | A | 62 | 1,207 | 937 | 0.776 |
| Comparative Example 3 | A | 62 | 1,211 | 878 | 0.725 |
| Comparative Example 4 | A | 71 | 1,184 | 951 | 0.803 |
| Comparative Example 5 | C | 61 | 973 | 845 | 0.868 |
| Comparative Example 6 | G | 96 | 1,557 | 1,143 | 0.734 |

TABLE 3-continued

| Example | Steel type | Fraction of martensite (vol %) | Tensile strength (MPa) | Yield strength (MPa) | Yield ratio |
|---|---|---|---|---|---|
| Comparative Example 7 | H | 42 | 949 | 784 | 0.826 |
| Comparative Example 8 | I | 43 | 1,099 | 871 | 0.793 |
| Comparative Example 9 | J | 88 | 1,315 | 964 | 0.733 |
| Comparative Example 10 | K | 81 | 1,231 | 874 | 0.710 |

In the cases of Examples 1 to 11, which satisfy the composition of alloying elements and manufacturing conditions according to the present disclosure, it was confirmed that the fraction of martensite was not less than 95 vol % and the yield ratio (yield strength/tensile strength) was not less than 0.75. In addition, in Examples 1 to 11, it was confirmed that the tensile strength of 1,250 MPa or more and the yield strength of 1,000 MPa or more were satisfied.

On the contrary, in the cases of Comparative Examples 1 to 10, which do not satisfy one or more of the composition of alloying elements and manufacturing conditions according to the present disclosure, the fraction of martensite was less than 95 vol %, or the yield ratio (yield strength/tensile strength) was less than 0.75.

Specifically, in the case of Comparative Example 1, the cooling termination temperature was below 150° C., and thus it may be confirmed that the yield ratio was low.

In the case of Comparative Example 2, the time from termination of the rolling to initiation of the cooling exceeds 5 seconds, and thus it may be confirmed that the fraction of martensite desired by the present disclosure was not obtained, and the tensile strength and the yield strength were low.

In the case of Comparative Example 3, the time from termination of the rolling to initiation of the cooling exceeds 5 seconds and the cooling termination temperature was below 150° C., and thus it may be confirmed that all of the tensile strength, the yield strength, and the yield ratio were low.

The cooling rate was low in Comparative Example 4 and the cooling termination temperature was high in Comparative Example 5, and thus transformation into martensite was not sufficiently performed, and the tensile strength and the yield strength desired by the present disclosure were not obtained.

The cooling termination temperature was low in Comparative Example 6, it was confirmed that the yield ratio was low.

The C content was low in Comparative Example 7 and the B content was low in Comparative Example 8, and thus it was confirmed that the fraction of martensite was less than 50 vol % and the tensile strength and the yield strength were low.

The Mn content was high in Comparative Example 9, and thus transformation into martensite was not sufficiently performed. Therefore, retained austenite was formed and it was confirmed that the tensile strength was high but the yield ratio was low.

Although Ti was added in Comparative Example 10, the Ti content was low, and thus transformation into martensite was not sufficiently performed, and thus it was confirmed that the tensile strength and the yield ratio were low.

While the present disclosure has been particularly described with reference to exemplary embodiments, it should be understood by those of skilled in the art that various changes in form and details may be made without departing from the spirit and scope of the present disclosure.

INDUSTRIAL APPLICABILITY

Because the hot-rolled steel sheet according to the present disclosure may obtain an excellent yield ratio and high strength even when a follow-up process such as heat treatment and cold rolling is not performed, the hot-rolled steel sheet may be applied to materials for automotive collision parts and structural supports.

The invention claimed is:

1. A hot-rolled steel sheet having an excellent yield ratio comprising, in percent by weight, 0.12% or more and less than 0.3% of C, more than 0 and 0.5% or less of Si, 0.1 to 2.5% of Mn, 0.0005 to 0.005% of B, 0.02% or less of P, 0.01% or less of S, and further comprising, in percent by weight, at least one selected from less than 0.2% of Cr and 0.005 to 0.2% of Ti, and the balance of Fe and inevitable impurities, having a microstructure including at least 95 vol % of martensite formed by continuous hot rolling and subsequent coiling, having a yield ratio of 0.75 or more, where yield ratio is defined as the ratio of yield strength to tensile strength, manufactured by continuous hot rolling, and manufactured without performing a follow-up process of cold rolling and heat treatment, wherein a yield strength is 1,227 MPa or more.

2. The hot-rolled steel sheet according to claim 1, wherein the microstructure comprises at least one of ferrite, bainite, retained austenite, and a carbide, and a sum thereof is 5 vol % or less.

3. The hot-rolled steel sheet according to claim 1, wherein a tensile strength is 1,250 MPa or more.

4. The hot-rolled steel sheet according to claim 1, wherein a thickness is 1.5 mm or less.

* * * * *